US005786552A

United States Patent [19]

Dohnal et al.

[11] Patent Number: 5,786,552

[45] Date of Patent: Jul. 28, 1998

[54] SWITCHING ARRANGEMENT FOR LOAD CHANGE-OVER SWITCHES OF STEP SWITCHES AND FOR SELECTOR SWITCHES

[75] Inventors: Dieter Dohnal, Lappersdorf; Hans-Henning Lessmann-Mieske, Neutraubling; Josef Neumeyer, Waldetzenberg; Leonhard Pillmeier, Regensburg, all of Germany

[73] Assignee: Maschinenfabrik Reinhausen GmbH, Regensburg, Germany

[21] Appl. No.: 704,626

[22] PCT Filed: Mar. 8, 1995

[86] PCT No.: PCT/EP95/00855

§ 371 Date: Sep. 25, 1996

§ 102(e) Date: Sep. 25, 1996

[87] PCT Pub. No.: WO95/24724

PCT Pub. Date: Sep. 14, 1995

[30] Foreign Application Priority Data

Mar. 9, 1994 [DE] Germany ..... 44 07 945.1
Nov. 18, 1994 [DE] Germany ..... 44 41 082.4

[51] Int. Cl.[6] ..... H01F 29/04

[52] U.S. Cl. ..... 200/11 TC; 323/340; 323/341

[58] Field of Search ..... 200/8 R, 8 A, 200/11 TC, 18; 323/255, 259, 340, 341, 343

[56] References Cited

FOREIGN PATENT DOCUMENTS

| | | |
|---|---|---|
| 756 435 | 5/1943 | German Dem. Rep. . |
| 25 20 670 B2 | 11/1976 | German Dem. Rep. . |
| 44 07 945 C1 | 3/1994 | Germany . |
| WO 94/02955 | 2/1994 | WIPO . |

*Primary Examiner*—Khanh Dang
*Attorney, Agent, or Firm*—Herbert Dubno

[57] ABSTRACT

The invention concerns a switching arrangement for load change-over switches of step switches and for selector switches, wherein two switching contacts movable in two directions are present. The first switching contact is in the form of a main switching contact and is connected to the load derivation by means of a first vacuum switchgear cell. The second switching contact is in the form of a resistance switching contact which is likewise connected to the load derivation by means of a series connection comprising a second vacuum switchgear cell and a transition resistor. Both the main and the resistance switching contacts can be moved independently of one another and without mutual coupling or influence. The main switching contact always reaches the new fixed contact abruptly and independently of the switching direction before the resistance switching contact leaves the previous fixed contact.

5 Claims, 8 Drawing Sheets

SWITCHING ARRANGEMENT FOR LOAD CHANGE-OVER SWITCHES OF STEP SWITCHES AND FOR SELECTOR SWITCHES

CROSS REFERENCE TO RELATED APPLICATIONS

This application is the US national phase of PCT application PCT/EP95/00855 filed 8 Mar. 1995 with a claim to the priorities of German patent application P 44 07 945.1 filed 9 Mar. 1994 and P 44 41 082.4 filed 18 Nov. 1994.

1. Field of the Invention

The invention relates to a switchover arrangement for load switches of tap changers and for load selectors. Such a switchover arrangement is known from German published application 2,520,670.

2. Background of the Invention

The known switchover arrangement of the German document has at least two bidirectionally movable switch contacts serving to switch a load output line from one to another tap contact, one switch contact serving as a main switch contact and the other as a switch contact resistance, with both resting in stationary condition on the same tap contact. The movable switch contacts are thus fixedly coupled together and mounted on a common contact carrier and are also jointly actuated by movement of the common contact carrier. Independent of the switching direction one contact always leads and the other follows.

Each of the movable switch contacts is in series with a mechanical series contact and the two series contacts are simultaneously and individually connectable with the load output line. This selectable connection is effected by a movable mechanical interrupting or switchover contact. In addition, with this known arrangement a force-storage unit is provided that, when tripped, actuates not only the two movable mechanically interconnected switch contacts as well as the interrupter contact.

These known switchover arrangements have several disadvantages. First, they always require a mechanical interrupter contact. Vacuum switching tubes, which are known for their fire-resistance and the resultant avoidance of fouling of the surrounding environment as well as for the large number of switch operations possible, cannot be used for the known switchover apparatus. In addition the switch contacts reverse their mechanical functions depending on switching direction from leading to trailing; the switch cycle changes with the switching direction. Both switch contacts must therefore be actuated jointly by the force-storage unit and in addition the force-storage unit must as described actuate the movable interrupter contact which forms the current connection to the load output line so that the result is, in general, a complicated mechanism and requires a correspondingly mechanically expensive force-storage unit.

OBJECT OF THE INVENTION

It is an object of the invention to provide a switchover arrangement of the above-described type that is usable for load switches and also for load selectors, which permits the use of vacuum switch tubes in the main and in the resistance branch, and which has a kinematically simple mechanism and thus an uncomplicated force-storage unit working in both directions and only making an always identical switch step for actuating the least possible switchover means.

SUMMARY OF THE INVENTION

This object is achieved by a switchover arrangement for load switches of tap changers and for load selectors with at least two fixed tap contacts and with two bidirectionally movable switch contacts switching a load output line from one fixed stepped contact to another fixed tap contact. The switching of the switch contacts is triggered by the spring-like release of a force-storage unit. One of the switch contacts is formed as a main switch contact connected directly with the load output line, while the other switch contact is connectable as a resistance switch contact in series with a switchover resistor to the load output line. The switch contact connectable as main switch with the load output line reaches the new fixed tap contact before the switch contact connectable as resistance switch contact with the load line leaves the previous fixed tap contact. According to the invention, both switch contacts being movable independently of each other without mechanical coupling or interconnection. One of the switch contacts being connected in permanent series contact with the switchover resistor so that independently of the switching direction always the same first switch contact is connected directly as the main switching contact and the second contact is always connected as the resistance switchover contact with the load output line. The connection of both the first switch contact acting as the main switch contact as well as the second switch contact acting as the resistance switch contact with the load output line is made by means of two separate and separately actuatable vacuum switches. Only the first switch contact acting as main switch contact is directly actuated by the spring-like force-storage unit.

At least one mechanical continuous main switch can also be provided and which in stationary condition shunts the first switch.

The resistance switch contact can be movable in a spring-like manner so that a two-stage force-storage unit first actuates the main switch contact and then with a time delay the resistance switch contact.

The resistance switch contact is movable in a spring like manner such that its movement is effected by a second force-storage unit tripped with a time delay.

The main switch contact and the resistance switch contact can be coaxially pivoted and the fixed tap contacts arranged in axially and perpendicular or radial direction so that they can be swept over independently of each other.

The main switch contact and the resistance switch contact are guided linearly independently of each other such that all fixed tap contacts can be swept over by both independently of one another.

Both the main switch contact and the resistance switch contact can each be formed by two coupled-together individual breaker contacts, one respective individual breaker contact both of the main switch contact as well as of the resistance contact being electrically connected with the first tap contact and the other individual breaker contact of both the main switch contact as well as of the resistance switch contact being electrically connected with the second fixed tap contact.

The individual breaker contacts of the main switch contact can be switched by a first reversing switch and the individual breaker contacts of the second switch contact by a second reverser switch.

It is particularly advantageous with the switchover arrangement according to the invention that with it the slightest possible switch loading is achieved. It is therefore possible to provide for safety reasons against the possible and statistically unignorable failure of a vacuum switch tube, a mechanical series emergency switching branch which can be provided in any event in the switchover arrangement according to the invention for a load selector and which can be monitored in a particularly simple manner by a known optoelectronic arc detector with load-switch extinguishing when needed. In addition as a result of the modest load switch loading of the switchover arrangement according to the invention it can be built with smaller and correspondingly cheaper vacuum switch tubes. A particular advantage of the switchover arrangement according to the invention is further that the separate actuation of the main switch contact on the one hand and of the resistance switch contact on the other hand allows for provision of a long switching path which is significant with respect to the spacing of the contact elements and thus of the achievable voltage stability as also with respect to the reseizing voltage when the emergency switching shunt is used. It is significant for the switchover arrangement according to the invention that, independent of the switching direction and thus of the movement (rotation) direction of the drive, the main switch contact is always actuated first in a spring-like manner.

German patent 756,435 describes in principle that on direction change of the contact movement of the step selector contacts the selector contact connected to the switchover resistor "passes" the other, but in this known solution both step selector contacts, i.e. the selector arms, are mechanically connected to each other and with the drive. The "passing" takes place either mechanically by a lost motion in the drive mechanism or electrically by two additional reversing switches which reverse the orientation, i.e. the switching of the step selector contacts on rotation-direction reversal. In the switchover arrangement according to the invention, by contrast, both contact arms move fully independently of each other. The main switch contact is moved spring-like by the tripped force-storage unit to the new fixed contact and the resistance switch contact follows with a selectable speed.

It is already known from WO 94/02955 for load selectors to have two selector arms that are independent of each other and movable without a mechanical interconnection. With this solution the resistance contact is moved slowly and continuously by the drive shaft toward the new contact while loading a force-storage unit and the switch contact follows this movement in a spring-like manner after tripping of the force-storage unit. The arrangement described there is however only suitable for load selectors. In addition this known arrangement for load selectors is known for high switch loading which makes essential additional means in excess of the emergency switching shunt in order to provide sufficient safety in spite of the statistically undeniable possibility of the failure of vacuum switch tubes. With the discussed switch loads with such arrangements it is also necessary to provide two vacuum switch tubes in series in the load branch which are preferably simultaneously actuated. This on the one hand increases the switch cost and also necessitates additional mechanical means for simultaneously actuating both vacuum switch tubes.

BRIEF DESCRIPTION OF THE DRAWING

The above and other objects, features, and advantages will become more readily apparent from the following description, reference being made to the accompanying drawing in which.

SPECIFIC DESCRIPTION

The switching cycles of the first switchover arrangement according to the invention are essentially the same independent of whether this switchover arrangement is part of a load switch or part of a load selector. The sole difference is that a load selector can be stepped through several positions while a load switch moves mainly between two positions so that each time the switching direction is reversed.

Figure 1:
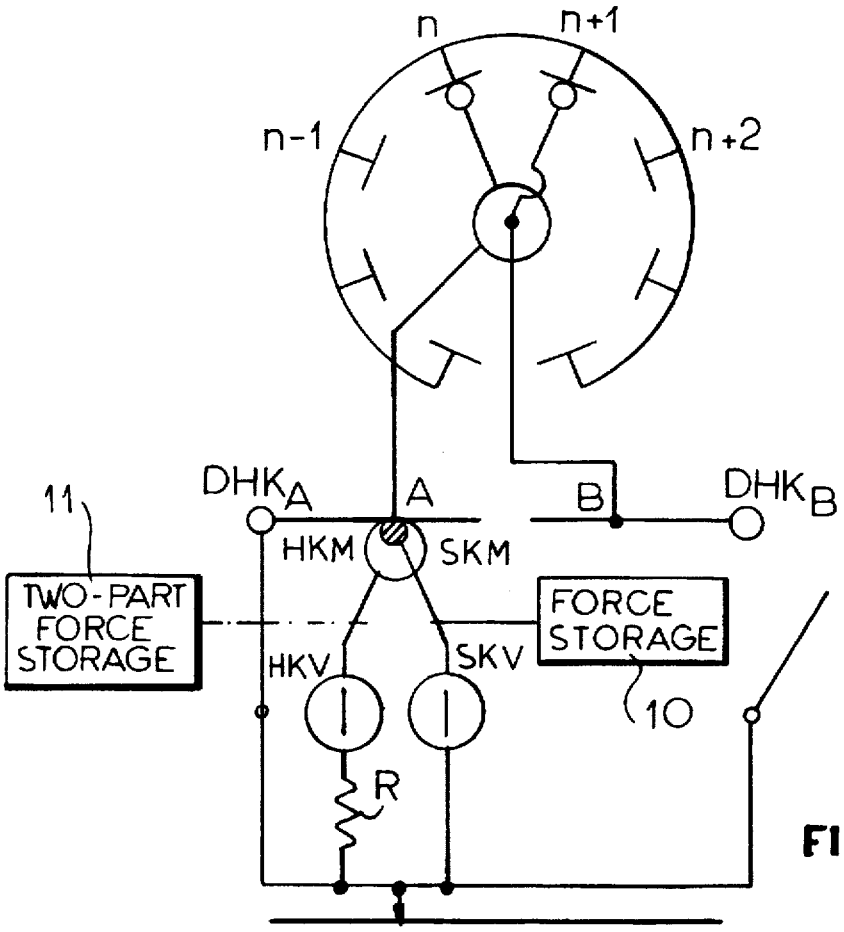
FIG. 1 is a diagram which shows a first switchover arrangement according to the invention as part of a load switch.

The switchover arrangement shown in FIG. 1 has two fixed tap contacts A, B which are connected in the known manner via a step selector with taps n, n+1, n+2. . . of the step winding.

The actual switchover arrangement moves between these contacts A and B. This consists of a main switch contact SKM which is connected via a first vacuum-switch cell SKV with a common output line as well as of a resistance switch contact HKM which is independent and mechanically decoupled therefrom and connected in series with a second vacuum-switch cell HKV and a switchover resistor R to the common output line. In addition in this embodiment there are preferably continuous main switches $DHK_A$ and $DHK_B$ which in stationary use conduct the load current and thus bypass the switchover arrangement. These continuous main switches are not strictly necessary for the operation of the switchover arrangement, so that load current can, when the vacuum-switch cells are appropriately dimensioned, be conducted also by the main switch contact SKM and the first vacuum-switch cell SKV, which is closed in stationary operation, in series therewith.

Figure 2:
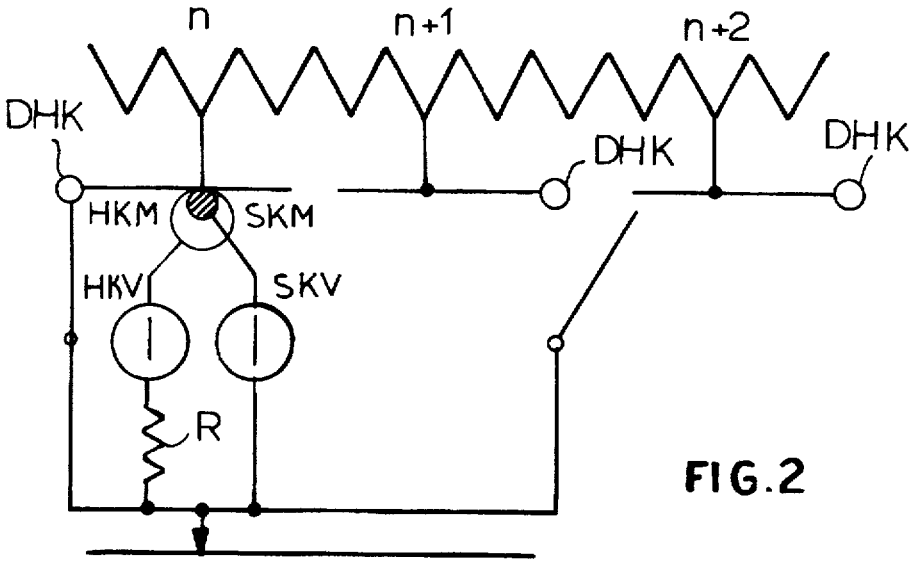
FIG. 2 is a diagram which shows this first switchover arrangement according to the invention as part of a load selector.

FIG. 2 is a diagram which shows this first switchover arrangement as a part of a load selector, where the continuous main switches are not strictly necessary; the differences between actuation of the switchover arrangement as part of a load switch on the one hand of a load selector on the other hand have already been given.

Figure 3:
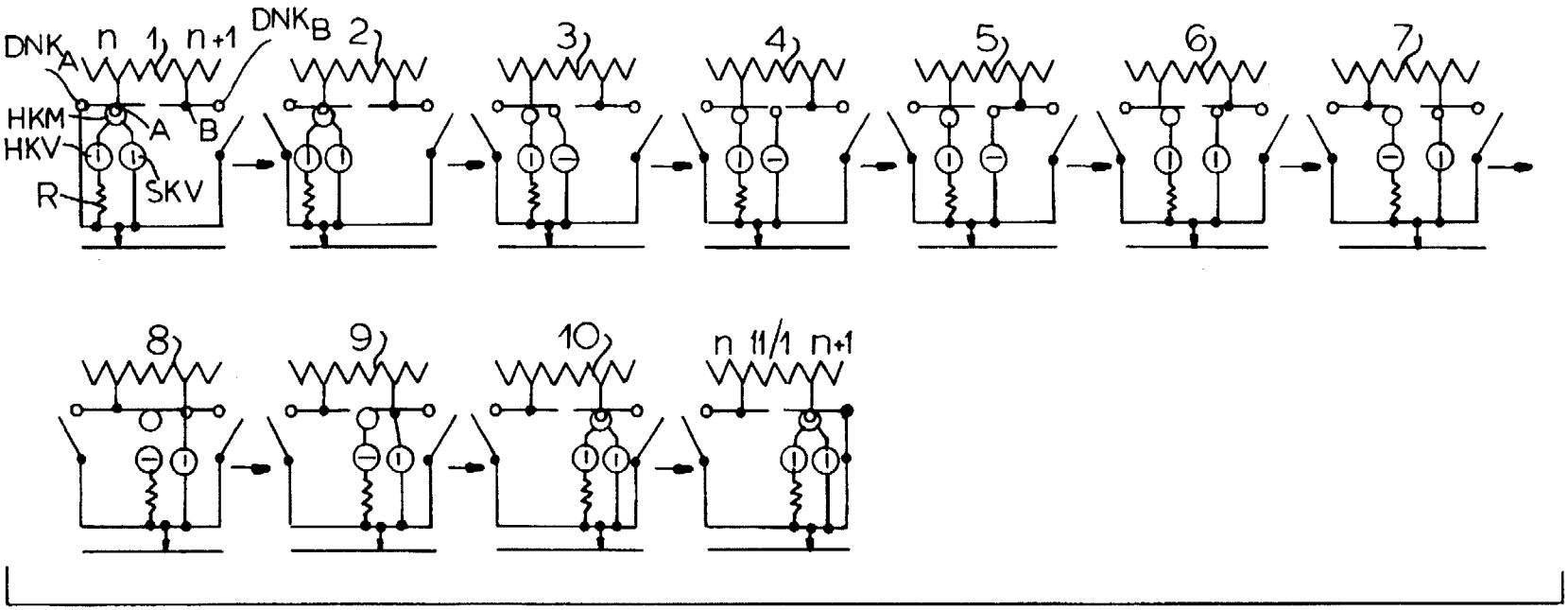
FIG. 3 is a sequence diagram which shows in this first switchover arrangement the steps necessary from one voltage level to another.
Figure 4:
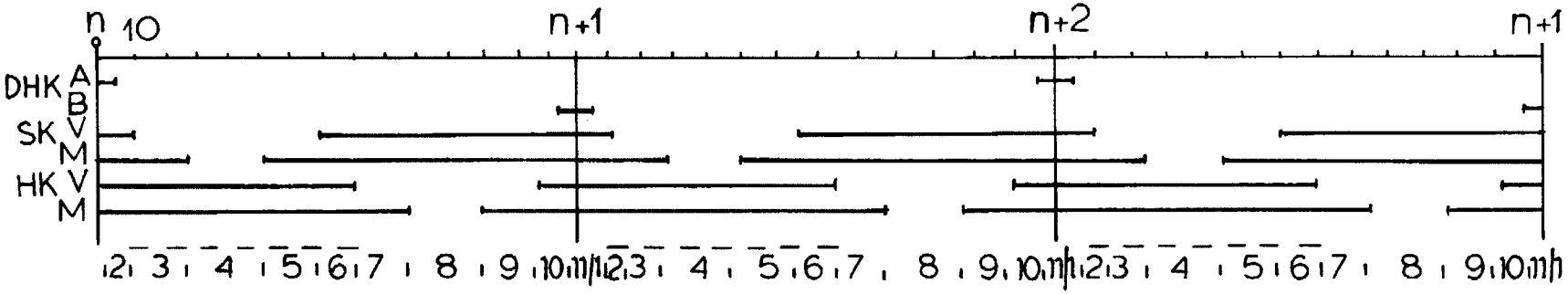
FIG. 4 is a timing diagram which shows the switching diagram for this first switchover arrangement for multiple tap changing.

FIG. 3 is a diagram which shows in the first switchover arrangement the necessary steps from one voltage level to another. These steps are independent of whether the switching is from a lower to a higher voltage level or vice versa. The individual steps are is a diagram which shows at 1 through 11.

Step 1: Starting position, $DHK_A$ conducts the load current.

Step 2: $DHK_A$ has opened, the main switch contact SKM and the first vacuum-switch tube SKV have taken over the load current.

Step 3: The first vacuum switch tube SKV has opened, the load current flows through the resistance switch contact HKM, the second vacuum switch tube HKV, and the switchover resistor R.

Step 4: The main switch contact SKM leaves the fixed contact n or A after tripping of a force-storage unit.

Step 5: The main switch contact SKM reaches the new fixed tap contact n+1 or B.

Step 6: The first vacuum switch cell SKV closes and switches the load current to the fixed tap contact n+1 or B; the still closed second vacuum switch cell HKV and the switchover resistor R conduct only the differential current.

Step 7: The second vacuum switch cell HKV opens and interrupts the flow of the differential current.

Step 8: The resistance switch contact HKM leaves the fixed tap contact n or A and follows the movement of the main switch contact SKM to the new fixed tap contact n+1 or B.

Step 9: The resistance contact HKM has reached the new fixed tap contact n+1 or B.

Step 10: The second vacuum switch cell HKV closes.

Step 11: The continuous main switch $DHK_B$ closes and takes over the load current. The starting position has been reached and the switchover arrangement is ready to be switched again.

It is clear that there is no addition of load and differential current, only a slight loading on switching.

It is thus clear that independently of whether one is moving to a higher or a lower voltage level, the main switch contact SKM moves rapidly first and the resistance switch contact HMK follows rapidly. It is thus necessary to actuate the main switch contact SKM rapidly by a tripped spring force or other energy-storage unit 10. The following resistance switch contact HKM can theoretically also follow slowly or continuously but this eliminates one of the advantages of the invention, that is the simple monitoring of the vacuum switch tubes by a mechanical emergency switching shunt. This emergency circuit is only possible when the resistance switch contact HKM follows rapidly. This rapid movement of the following resistance switch contact HKM is possible by means of a two-part force-storage unit 11 or two interconnected force-storage units so that after tripping of a first force-storage unit and movement of the main switch contact SKM with a time delay a second force-storage unit is tripped which causes the resistance switch contact HKM to follow.

Figure 5:
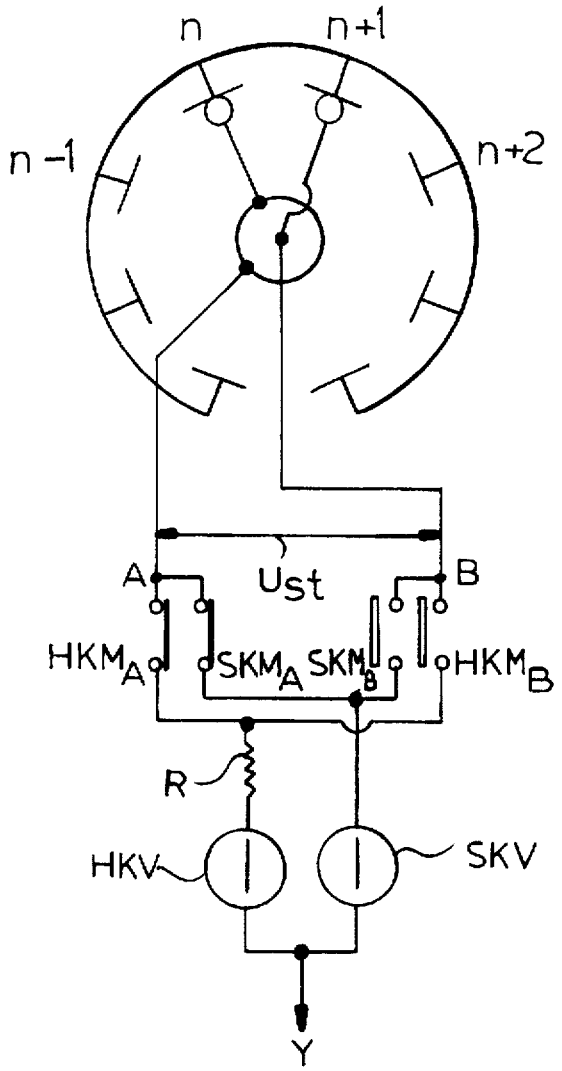
FIG. 5 is a view similar to FIGS. 1 and 2 which shows a second switchover arrangement according to the invention as part of a load switch.

FIG. 5 is a diagram which shows a second switchover arrangement according to the invention which is specially set up for load switches where as described one only moves between two fixed contacts A and B. As a particularly advantageous feature of the invention the main switch contact SKM as well as the resistance switch contact HKM each consist of two interconnected and coupled individual breaker contacts $SKM_A$, $SKM_B$ and $HKM_A$, $HKM_B$, each individual contact $SKM_A$ and $HKM_B$ being electrically connected with the first tap contact A and the other individual breaker contacts $SKM_B$ and $HKM_B$ being electrically connected to the other tap contact B. In this embodiment of the invention there are thus two double interruptions; in this manner a simple load switching is possible during switchover in which only simple interrupters, contact bridges or the like are necessary as mechanical switch elements.

Figure 6:
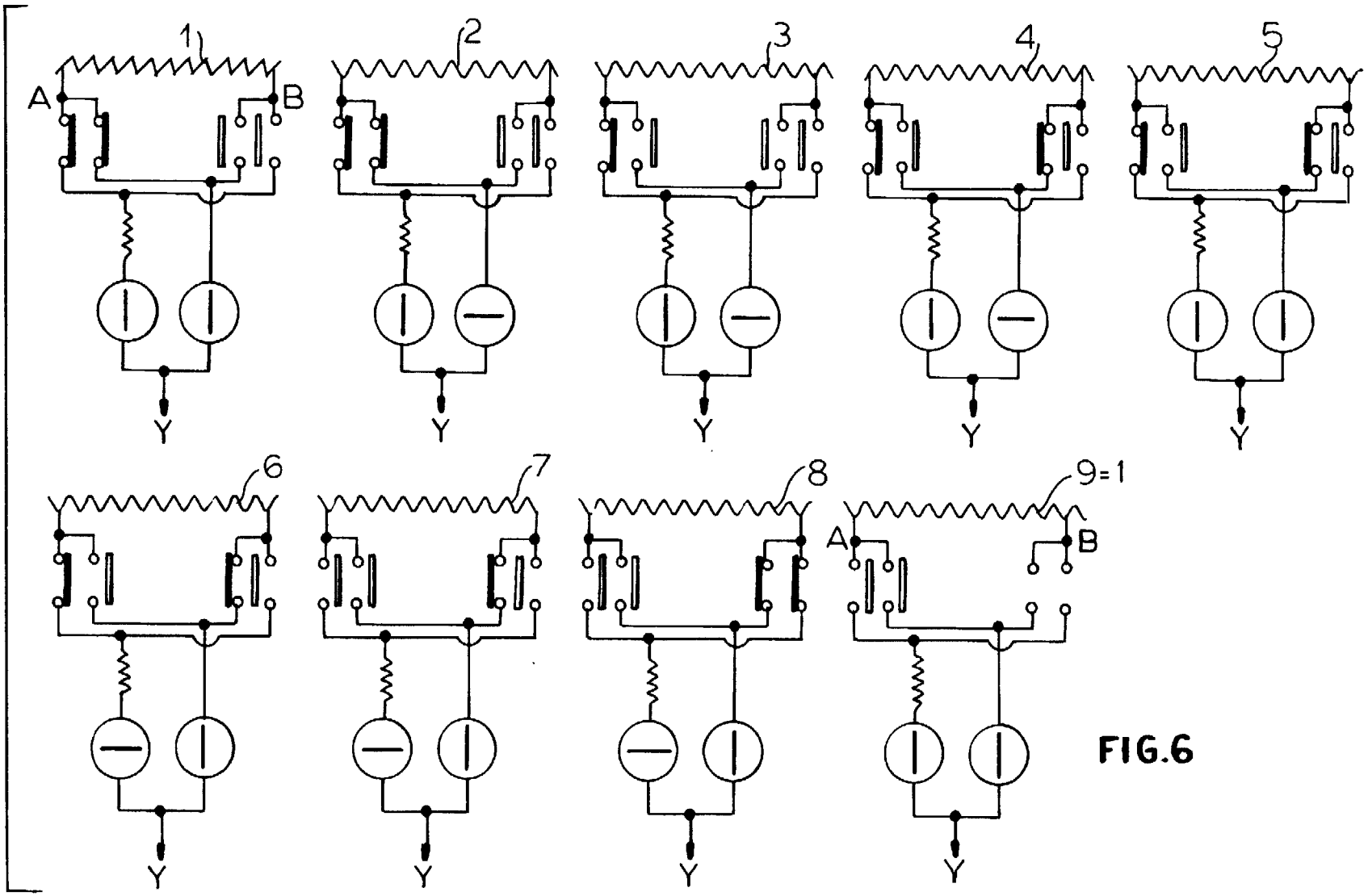
FIG. 6 is a sequence diagram which shows in this second switchover arrangement the necessary switching steps from one voltage level to another.

FIG. 6 is a diagram which shows the appropriate switching cycle. It is clear that here permanent connections are merely closed or opened for transmitting the load through the respective individual breaker contacts.

Figure 7:
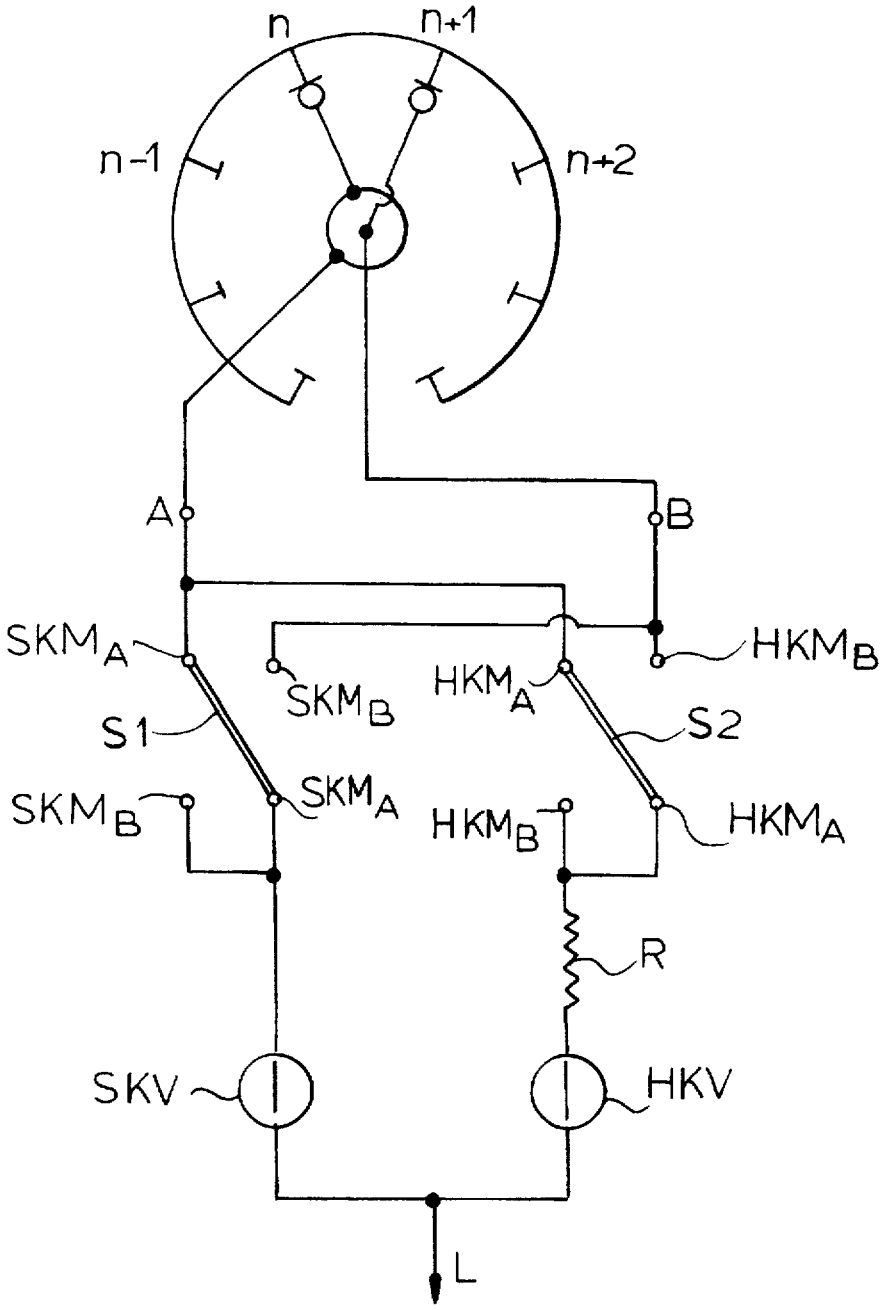
FIG. 7 is another diagram which shows a third switchover arrangement according to the invention as part of a load switch.

FIG. 7 is a diagram which shows a third embodiment of a switchover arrangement according to the invention. This embodiment is also set up specially for load switches where once again the switching only takes place between two fixed tap contacts A and B. The further above-described individual breaker contacts $SKM_A$, $SKM_B$ of the main switching circuit SKM as well as the individual breaker contacts $HKM_A$ and $HKM_B$ of the resistance switch contact HKM are here switched by two reversing switches S1 and S2. The first reversing switch S1 selectively closes the individual breaker contact $SKM_A$ or the individual breaker contact $SKM_B$. Here there is thus a double interruption by means of four individual breaker contacts which are in a special manner switched by only two reversing switches S1 and S2.

Figure 8:
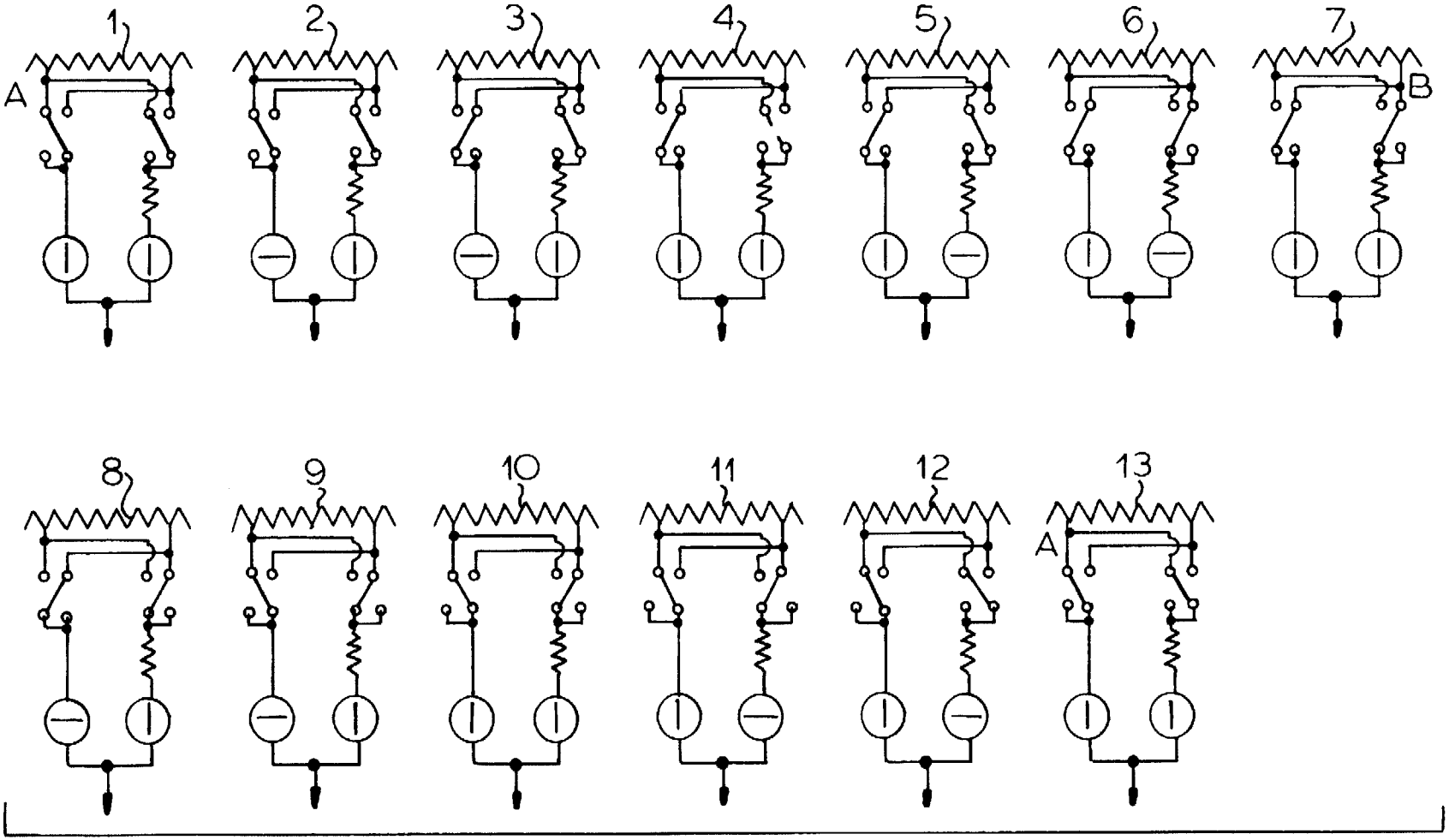
FIG. 8 is a sequence diagram which shows in this third switchover arrangement the necessary steps from one voltage-level to another and back again.
Figure 9:
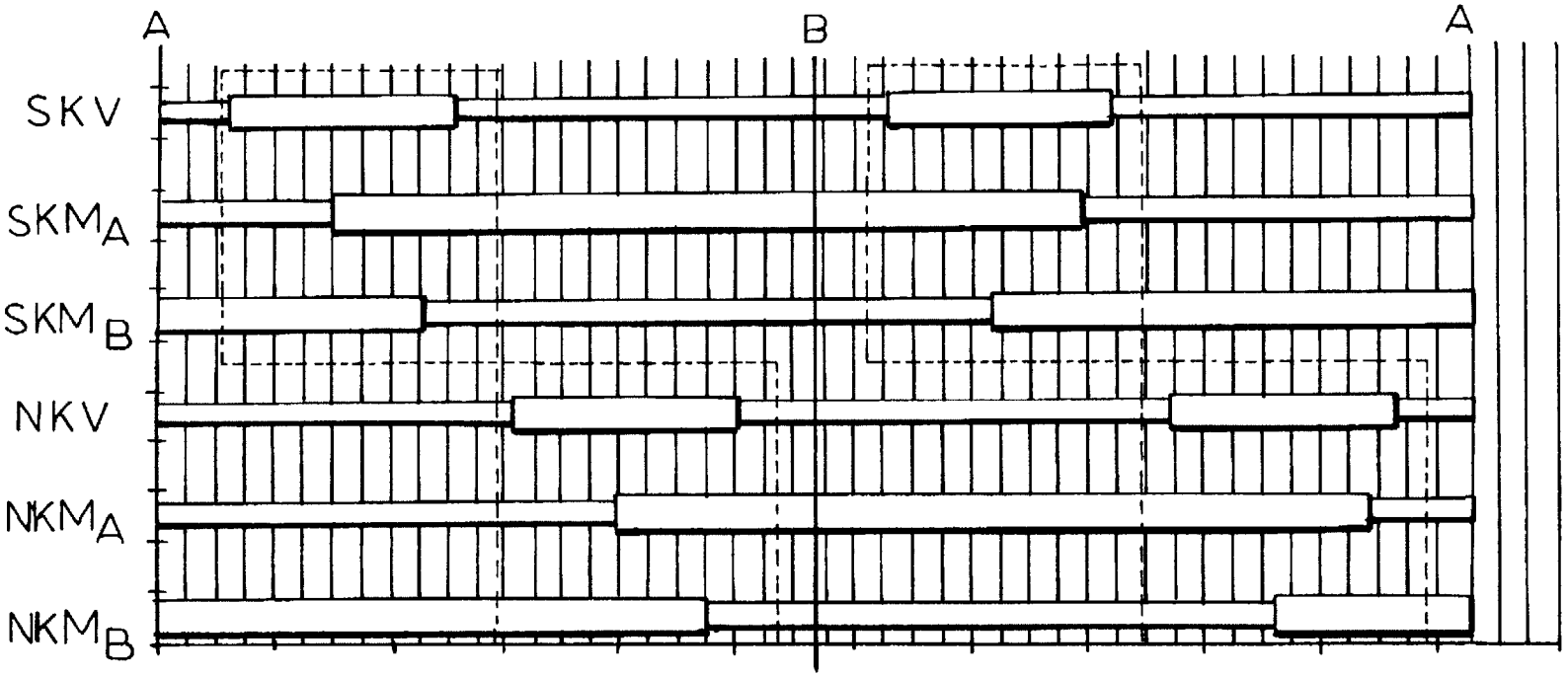
FIG. 9 is a timing diagram which shows the switching diagram for this third switchover arrangement.

FIG. 8 is a diagram which shows the switching cycle from the fixed tap contact A to the fixed tap contact B and back again. One can see that even in this embodiment the main switch contact reaches the new fixed contact B, that is to connect same with the load output line L directly, before the resistance switch contact leaves the previous fixed tap contact, that is before the previous connection via the switchover resistor R with the load line L is broken. It is further clear that in all described embodiments of the invention the movement or the actuation of the main switch contact on the one hand and the resistance switch contact on the other hand takes place without a mechanical interconnection. Even in the last-described embodiments it is also possible to provide additional continuous main switches which in a stationary condition transmit the main current flow.

We claim:

1. An under-load switch comprising:

two spaced apart fixed contacts connected in an electrical circuit and selectively connectable under load;

a main switch contact and a resistance switch contact connected to a load mechanically decoupled from one another and movable independently from one another bidirectionally between said fixed contacts so that, independently of direction of movement, said main switch contact always engages a fixed contact to be selected before the resistance switch contact engages the fixed contact to be selected;

a switchover resistance in series with said resistance switch contact and between said resistance switch contact and said load;

a main vacuum switch cell connected in series with said main switch contact between said main switch contact and said load, and a resistance vacuum switch cell connected in series with said resistance switch contact between said resistance switch contact and said load, said vacuum switch cells being selectively rendered conductive and nonconductive independently of one another; and a first force storing unit connected to said main switch contact and a second force-storing unit connected with said resistance switching unit for:

tripping of said first force storing unit to jump said main switch contact into engagement with the fixed contact to be selected before said resistance switch contact leaves a prior fixed contact, and thereafter tripping of said second force storing unit after a time delay to jump said resistance switch contact into engagement with said fixed contact.

2. The underload switch defined in claim 1 wherein said main switch contact and said resistance switch contact are displaceable about a common axis and said fixed contacts extend in at least one of an axial direction and a radial direction so that said main switch contact and said resistance switch contact can be moved into engagement with said fixed contacts independently.

3. The underload switch defined in claim 1 wherein said main switch contact and said resistance switch contact are displaceable independently from one another linearly and said fixed contacts are so arranged and constructed that they can be independently swept over by said main switch contact and said resistance switch contact.

4. An under-load switch comprising:

two spaced apart fixed contacts connected in an electrical circuit and selectively connectable under load;

a main switch contact and a resistance switch contact connected to a load mechanically decoupled from one another and movable independently from one another bidirectionally between said fixed contacts so that, independently of direction of movement, said main switch contact always engages a fixed contact to be selected before the resistance switch contact engages the fixed contact to be selected;

a switchover resistance in series with said resistance switch contact and between said resistance switch contact and said load;

a main vacuum switch cell connected in series with said main switch contact between said main switch contact and said load, and a resistance vacuum switch cell connected in series with said resistance switch contact between said resistance switch contact and said load, said vacuum switch cells being selectively rendered conductive and nonconductive independently of one another; and a force storing unit connected to said main switch contact, the main switch contact and the resistance switch contact each being comprised of a pair of coupled and commonly actuated breaker contacts capable of sequentially making and breaking an electrical circuit for the respective switch contact and positioned so that one of said breaker contacts of the main switch contact opens a connection with a prior fixed contact before a second breaker contact of said main switch contact closes on a fixed contact to be selected and a first breaker contact of said resistance switch contact opens at said prior fixed contact before a second breaker contact of said resistance switch contact closes on said fixed contact to be selected.

5. The underload switch defined in claim 4 wherein the breaker contacts of each pair are provided on respective rotary switches.

* * * * *